US006467617B1

(12) United States Patent
Chen

(10) Patent No.: US 6,467,617 B1
(45) Date of Patent: Oct. 22, 2002

(54) OPEN-STYLE PACKAGING ARRANGEMENT FOR FISHING REEL

(75) Inventor: Shixiong Chen, Columbia, SC (US)

(73) Assignee: Shakespeare Company, Columbia, SC (US)

( * ) Notice: Subject to any disclaimer, the term of this patent is extended or adjusted under 35 U.S.C. 154(b) by 28 days.

(21) Appl. No.: 09/434,148

(22) Filed: Nov. 4, 1999

(51) Int. Cl.[7] ..... B65D 85/00
(52) U.S. Cl. ..... 206/315.11; 206/471; 206/806
(58) Field of Search ..... 206/315.11, 470, 206/471, 467, 806, 349; 43/26, 54.1

(56) References Cited

U.S. PATENT DOCUMENTS 2,149,087 A * 2/1939 Fisher ..... 43/54.1
3,762,592 A * 10/1973 Mayes ..... 43/26
4,165,805 A * 8/1979 Fethke et al. ..... 206/349
4,359,161 A * 11/1982 Sinoff ..... 206/461
4,493,416 A * 1/1985 Steinman ..... 206/315.11
4,872,551 A * 10/1989 Theros ..... 206/349
4,899,877 A * 2/1990 Kiernan ..... 206/349
4,946,034 A * 8/1990 Matsubara ..... 206/315.11
5,279,417 A * 1/1994 Seaton ..... 206/349
5,293,993 A * 3/1994 Yates, Jr. et al. ..... 206/470
5,540,324 A * 7/1996 Knapp ..... 206/6.1
5,595,295 A * 1/1997 Lin ..... 206/349
5,956,885 A * 9/1999 Zirbes ..... 43/26

* cited by examiner

*Primary Examiner*—Shian Luong
(74) *Attorney, Agent, or Firm*—Nelson Mullins Riley & Scarborough

(57) ABSTRACT

An improved packaging arrangement for a fishing reel permits the reel to be tested by a consumer on a limited basis while remaining in the package. The package is preferably formed of a semirigid plastic material defining a configured reel enclosure in which the reel's body is located. A rotatable crank extends for free rotation through a crank opening defined in the package. A crank handle is located at the distal end of the rotatable crank so as to be exterior to the package. Often, the package will further define a posterior opening permitting access to a thumb button located on the reel's body. The package preferably defines a hang aperture so that the packaged reel may be presented for sale on a hanging display in a manner similar to blister pack arrangements of the prior art.

21 Claims, 8 Drawing Sheets

OPEN-STYLE PACKAGING ARRANGEMENT FOR FISHING REEL

BACKGROUND OF THE INVENTION

The present invention relates generally to the art of fishing reels. More particularly, the invention relates to a novel packaging arrangement by which a fishing reel may be presented to a consumer for sale.

Several techniques are used by retail facilities to display fishing reels for sale to consumers. For example, reels may be stored in paper boxes, which can be opened to allow access to the reel inside. One advantage of this technique is that the consumer will have the opportunity to operate the reel prior to purchase. Due to shoplifting concerns, however, many retail stores will only locate boxed reels behind a sales counter. As a result, the consumer may not be able to operate the reel except in the presence of a salesperson. In addition, boxed reels are generally not suitable for hanging, or so-called "peg board," display.

Alternatively, reels may be packaged in a "blister pack," i.e., a sealed package made of transparent and semirigid plastic material. Typically, a blister pack will include a hanging aperture for peg board display. In addition, the transparent nature of the blister pack permits the reel to be visually inspected by a consumer. Because the blister pack is closed, however, the user cannot operate the reel prior to purchase.

SUMMARY OF THE INVENTION

The present invention recognizes and addresses the foregoing disadvantages, and others, of prior art constructions and methods. Accordingly, it is an object of the present invention to provide a novel packaging arrangement for a fishing reel.

It is a further object of the present invention to provide a novel packaging arrangement for a fishing reel that facilitates manual inspection of the reel by a consumer.

It is a more particular object of the present invention to provide a novel packaging arrangement that permits a consumer to operate a fishing reel on a limited basis while the reel remains packaged.

It is also an object of the present invention to provide a novel blister pack arrangement for a fishing reel.

Some of these objects are achieved by a fishing reel packaging arrangement comprising a fishing reel and a package. The fishing reel has a rotatable crank extending from a reel body located in a configured reel enclosure of the package. A crank handle is located on the rotatable crank. The rotatable crank extends through a crank opening defined in the package such that the crank handle will be located exterior to the package for rotation by a user. Often, the package may be formed of a semirigid plastic material.

In many cases, the fishing reel may include a thumb button located on the reel body. For example, the fishing reel may be a baitcast reel or a spincast reel. Preferably, the package in these embodiments may further define a posterior opening at the configured reel enclosure so that the user can operate the thumb button.

Often, the fishing reel may include a mounting foot. In such embodiments, the package may define a foot opening at the configured reel enclosure through which the mounting foot is exposed.

The package may comprise a first shell and a second shell of the selected plastic material. In such embodiments, the first and second shells are preferably joined together about respective peripheries thereof. Preferably, the package may define a hang aperture spaced from the configured reel enclosure.

In some cases, the package may have a generally T-shaped configuration formed by a lower portion of lesser width and an upper portion of greater width. In such embodiments, the configured reel enclosure is preferably located in the lower portion of lesser width and the hang aperture is located in the upper portion of greater width. The upper portion may advantageously extend laterally from at least one side of the lower portion by a lateral distance at least equal to a lateral extent of the crank handle.

In other embodiments, the package may have a generally triangular configuration in which the hang aperture is located adjacent an apex thereof.

Other objects of the present invention are achieved by a fishing reel packaging arrangement comprising a fishing reel and a package. The fishing reel has a reel body carrying a crank handle and a thumb button. The package is formed of a first shell and a second shell made of a semirigid plastic material. The first and second shells are joined together about respective peripheries thereof to provide a reel enclosure in which the reel body is located. The crank handle is advantageously located exterior to the package for rotation by a user. Preferably, the package further defines a posterior opening such that the user can operate the thumb button.

Particularly where a spincast reel is packaged, the package may further define a line opening providing access to an end portion of fishing line carried by the reel. For example, the line opening may be defined in the first shell of the package, with the second shell defining a bubble portion opposed to the line opening for receipt of a line tab therein.

Still further objects of the present invention are achieved by a fishing reel packaging arrangement comprising a fishing reel and a package. The fishing reel includes a reel body carrying a crank handle and a thumb button. The package defines a reel enclosure in which the reel body is located. Due to the construction of the package, the crank handle is located exterior to the package for rotation by a user. The package further defines a posterior opening at the reel enclosure such that the user can operate the thumb button. In addition, a hang aperture is spaced from the configured reel enclosure.

Additional objects of the present invention are achieved by a package for a fishing reel of the type including a reel body, a rotatable crank, and a thumb button. The package comprises a semirigid plastic material defining a configured reel enclosure in which the reel body is located. The package further defines a crank opening through which the rotatable crank extends such that the crank handle will be located exterior to the package for rotation by a user. A posterior opening is also defined at the configured reel enclosure so that the user can operate the thumb button.

Still further objects of the present invention are achieved by a fishing reel packaging arrangement comprising a fishing reel and a package. The package has a configured reel enclosure in which the reel body of the fishing reel is located. The package further defines an opening through which an operational component of the reel can be accessed while the reel remains packaged.

Other objects, features and aspects of the present invention are achieved by various combinations and subcombinations of the disclosed elements, which are discussed in greater detail below.

BRIEF DESCRIPTION OF THE DRAWING

A full and enabling disclosure of the present invention, including the best mode thereof, to one of ordinary skill in the art, is set forth more particularly in the remainder of the specification, including reference to the accompanying drawings, in which.

Figure 1:
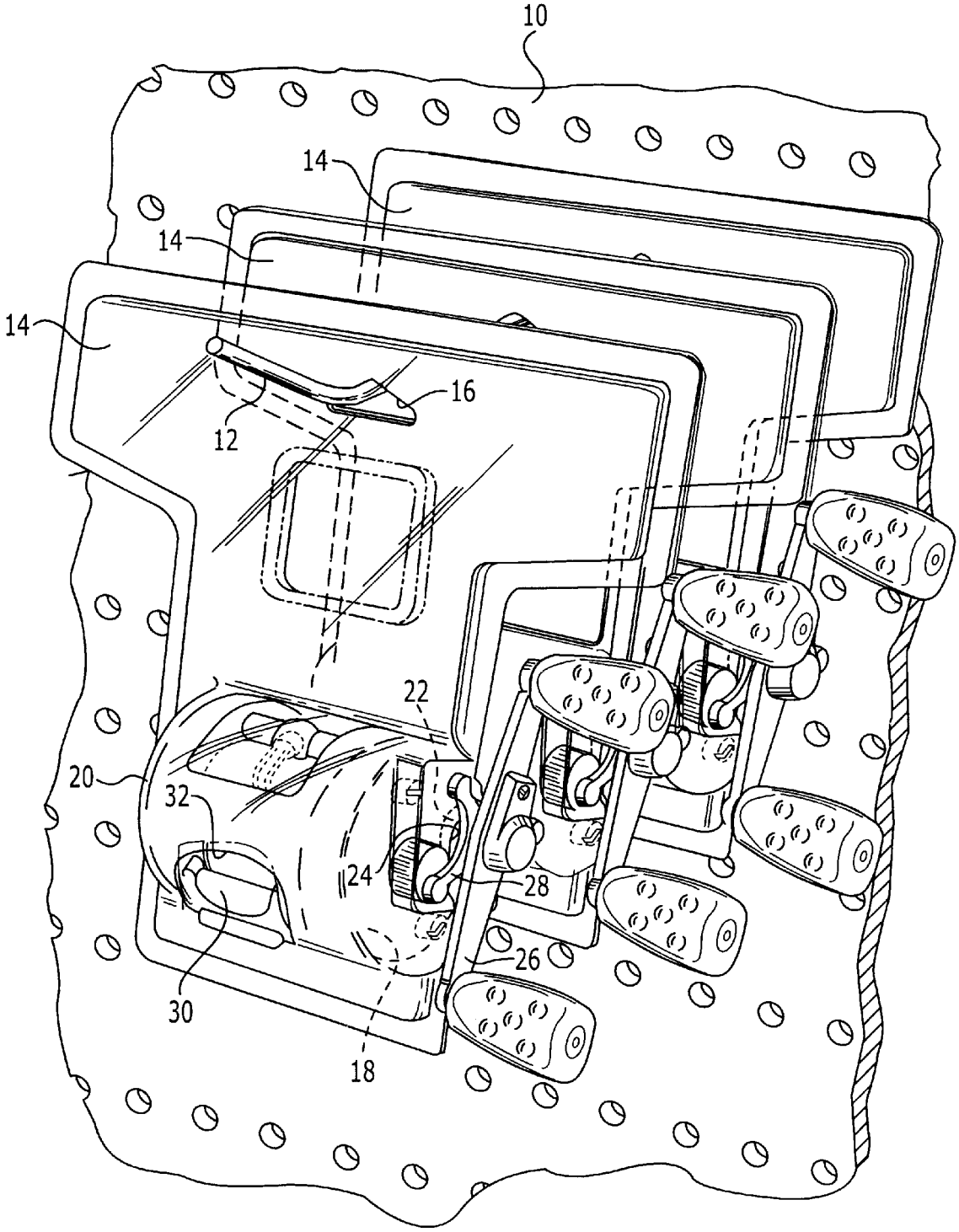
FIG. 1 illustrates a plurality of baitcast fishing reels packaged according to the present invention as they may appear on a hanging display.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a plurality of fishing reels packaged according to the present invention and presented for sale on a typical hanging display. As shown, the hanging display includes a baseboard 10 from which a hanging member 12 extends in cantilevered fashion. Each of the packages 14 defines a hang aperture, such as the one indicated at 16, through which hanging member 12 extends. Hanging aperture 16 is preferably sized to permit package 14 to be easily placed on, and removed from, the hanging display when desired.

In this case, the respective reels associated with each of packages 14 are of a type referred to as "baitcast" reels. As shown, each of the reels has a reel body 18 located inside of a configured reel enclosure 20. The reel further includes a rotatable crank 22 extending through a crank opening 24 defined in reel enclosure 20. A crank handle 26 is located at the distal end of rotatable crank 22 so as to be exterior to package 14. In some embodiments, the reel will further include a drag star 28 which may also be located outside of package 14, as shown.

The fishing reel may further include a thumb button 30 located on reel body 18. A posterior opening 32 is preferably defined in reel enclosure 20, thus allowing access to thumb button 30. This opening is referred to herein as a "posterior opening" because it is located adjacent to the posterior of the reel body. In addition, posterior opening 32 is preferably sized to permit the user's thumb to touch the reel's internal spool 34 (which is clearly shown in FIG. 3).

Figure 2:
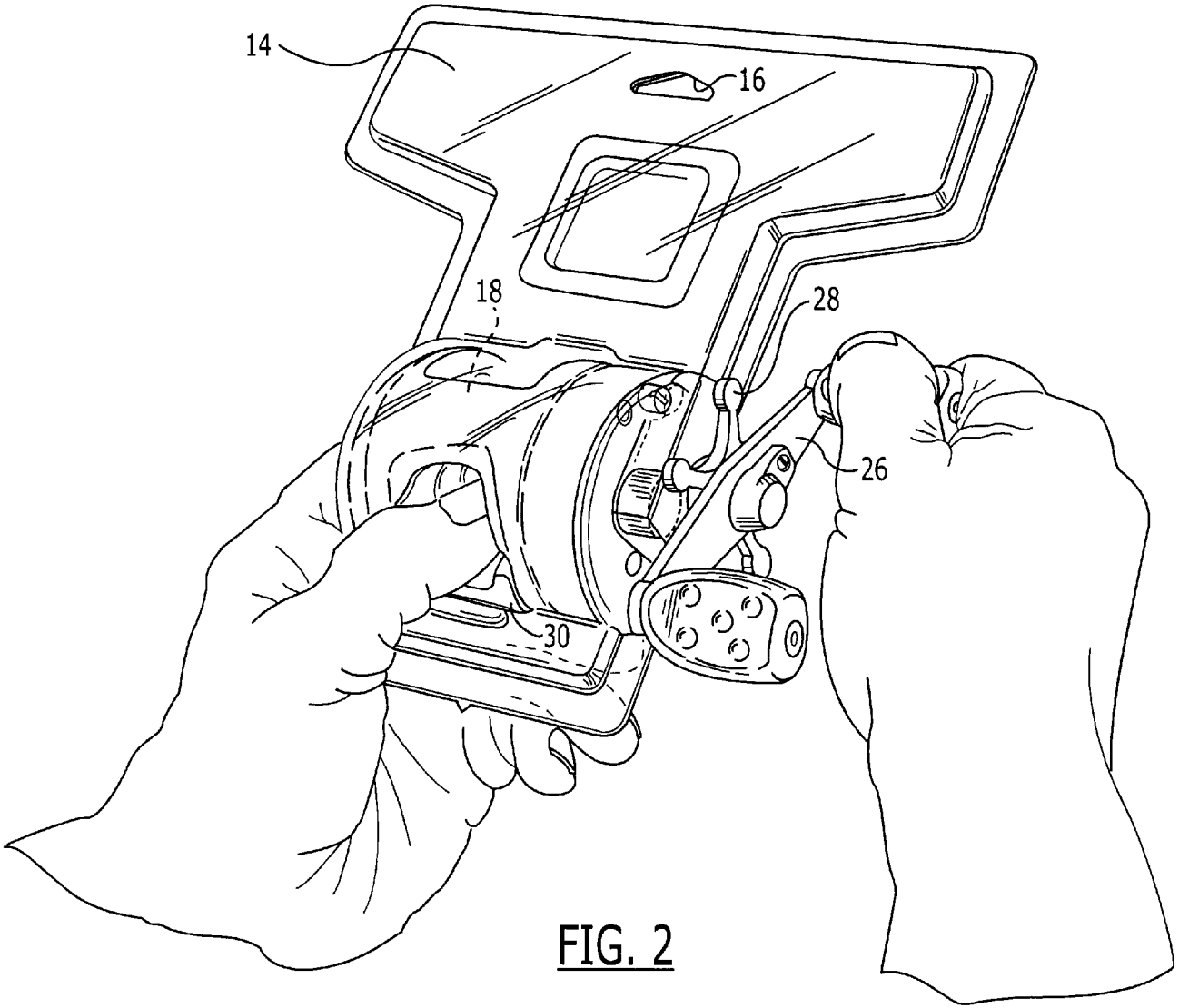
FIG. 2 illustrates one of the packaged fishing reels of FIG. 1 removed from the display and being operated by a user prior to purchase.

Referring now to FIG. 2, the packaging arrangement of the present invention provides several distinct advantages over packaging arrangements of the prior art. Because crank handle 26 is located external to package 14, it may be freely rotated by a consumer. The consumer can also depress thumb button 30, and can feel spool rotation caused by operation of crank handle 26.

Figure 3:
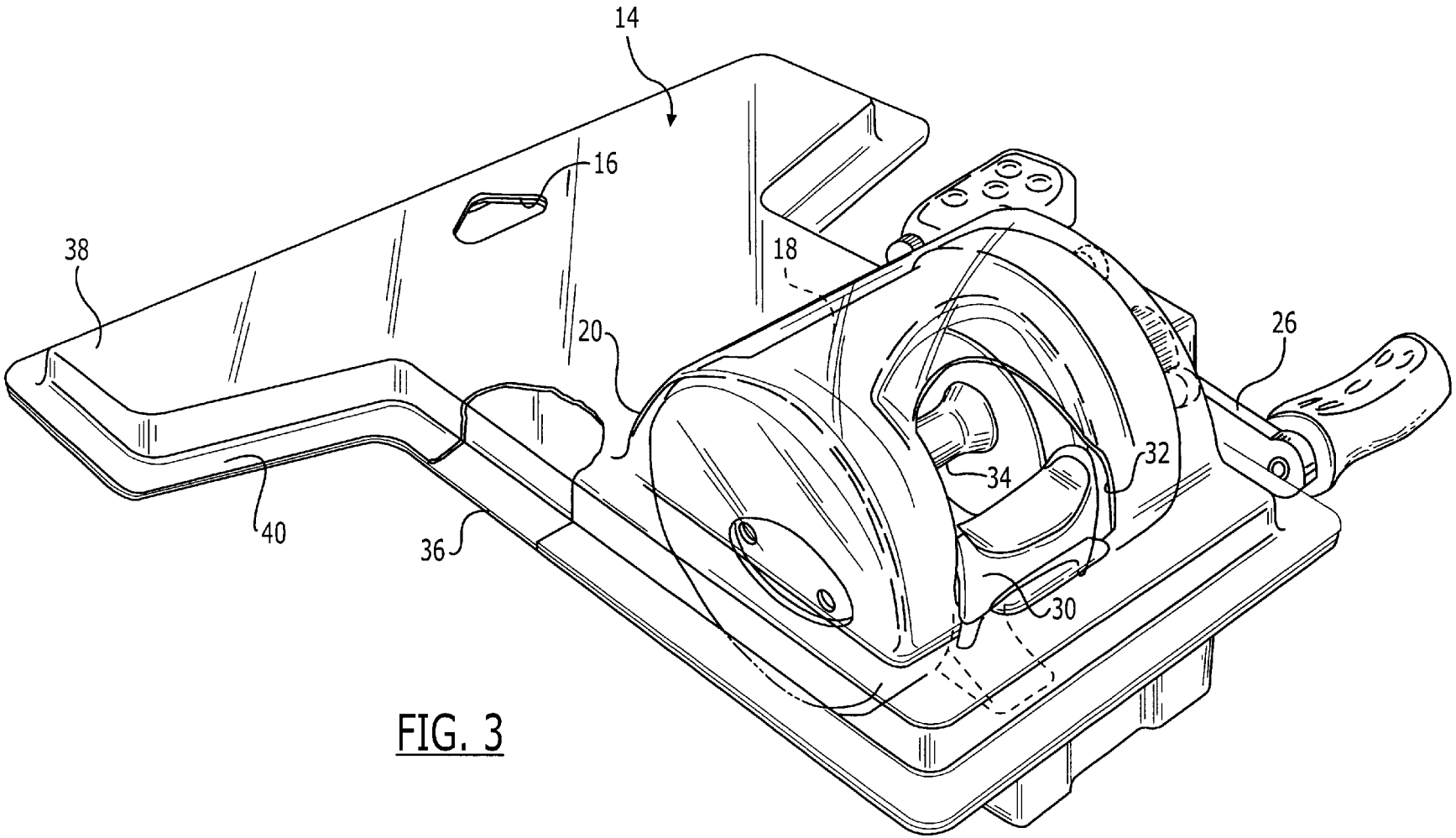
FIG. 3 is a top perspective view of the packaged fishing reel of FIG. 2.
Figure 4:
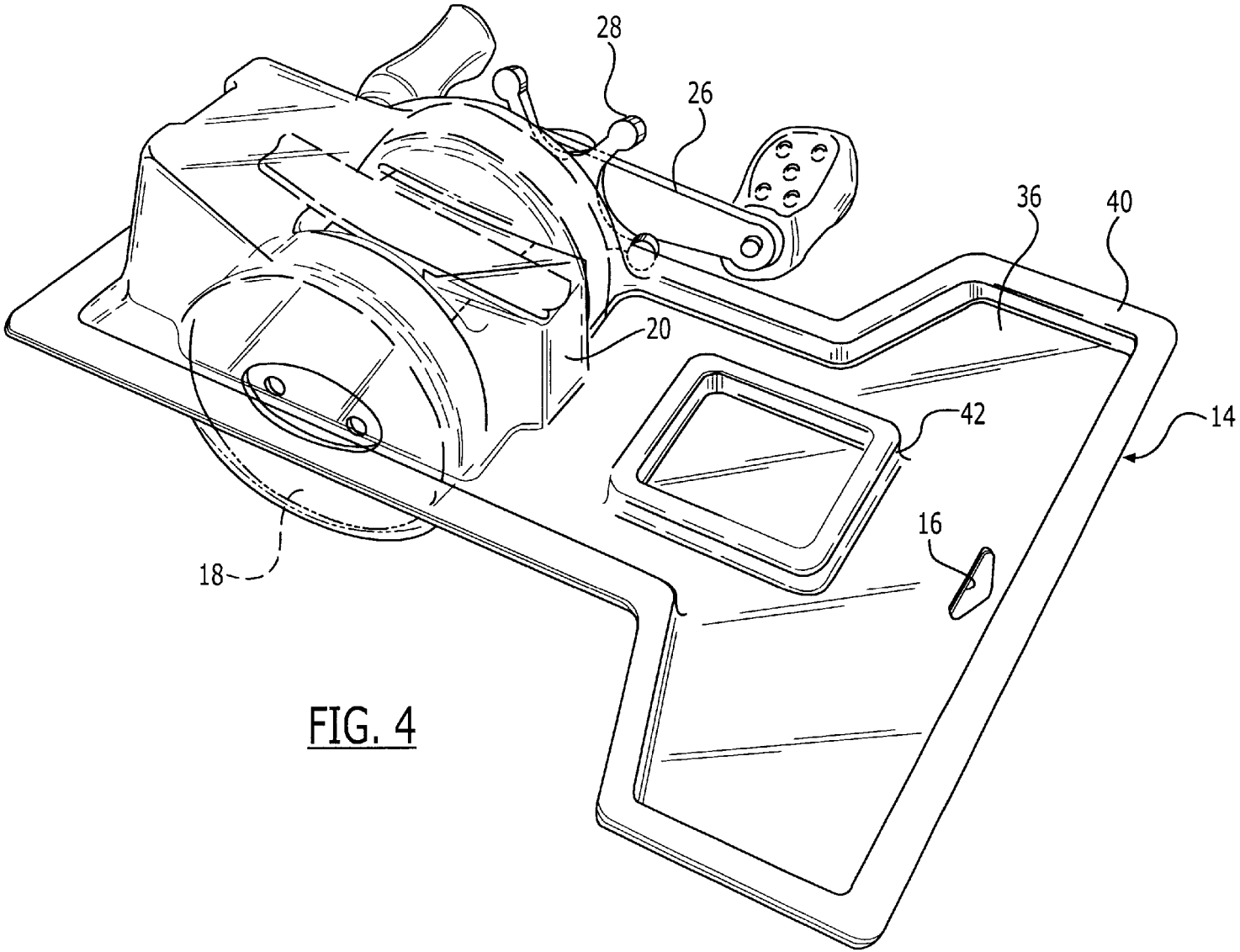
FIG. 4 is a bottom perspective view of the packaged fishing reel of FIG. 2.

Further details of the manner in which package 14 is constructed will be described with reference to FIGS. 3 and 4. It will often be desirable to manufacture package 14 from a semirigid plastic material such as that used to produce blister packs of the prior art. Alternatively, the package may be made from a rigid plastic material, or even metal. Embodiments in which the package is made from paperboard are also contemplated.

In the illustrated embodiment, the package is produced from a first shell 36 and a second shell 38, each made from a semirigid plastic material. As shown, second shell 38 may define a tray into which a slightly smaller tray of first shell 36 is received. After the fishing reel has been positioned therein, shells 36 and 38 are joined together at their common periphery 40, such as by adhesive, ultrasonic welding, or other suitable technique. In cases where the plastic material is transparent, a paperboard insert printed with manufacturer and model information may also be placed between the shells.

Various features may be provided, if desired, in order to increase the rigidity of the overall package. In this case, for example, first shell 36 defines a raised wall 42 in the shape of a square to enhance the package's overall rigidity.

Figure 5A:
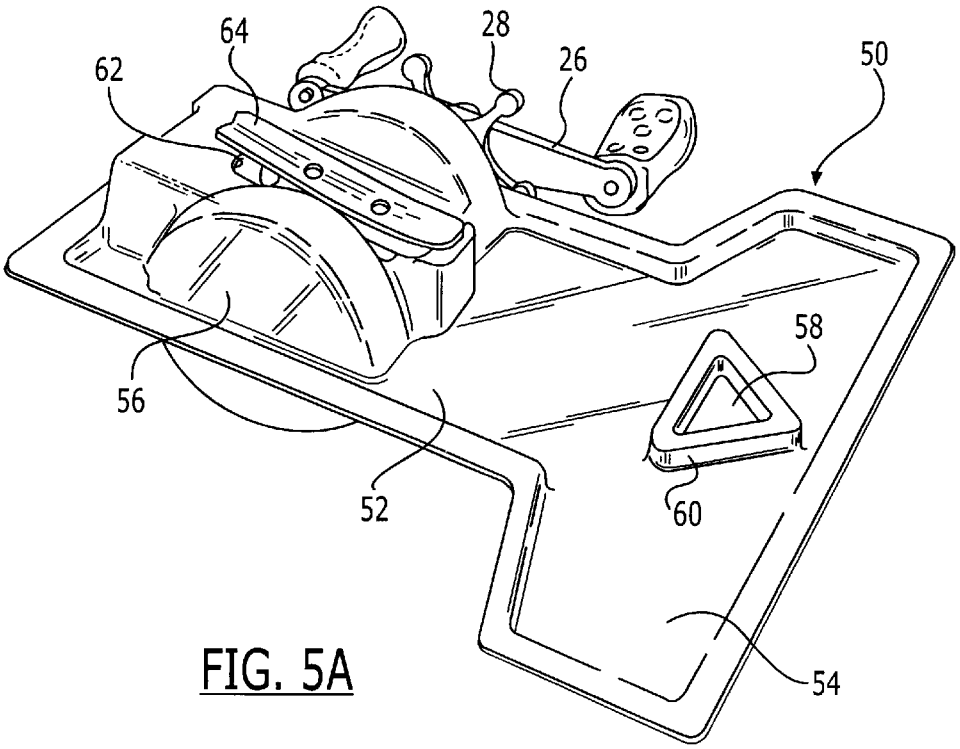
FIG. 5A is a bottom perspective view of a first alternative embodiment of a packaged fishing reel according to the present invention.

FIG. 5A illustrates a package 50 which is similar in many respects to package 14. For example, package 50 is constructed having a lower portion 52 of lesser width and an upper portion 54 of greater width so as to provide a "T-shaped" configuration. A configured reel enclosure 56 is defined in lower portion 52, as shown. Upper portion 54 defines a triangular hang aperture 58, in this case bordered by a triangular wall 60. It will be appreciated that triangular wall 60 functions to enhance the overall rigidity of the package in a manner similar to that of raised wall 42 discussed above.

As will now be described, package 50 includes an additional feature not present in package 14 that may be desirable in some applications. Specifically, package 50 defines a foot opening 62 at reel enclosure 56. A mounting foot 64, attached to the reel body, is exposed through foot opening 62. As a result, the reel can be mounted to a fishing rod while it remains in package 50. This can be used by a retailer, for example, to make a combination set for demonstration or sale.

Figure 5B:
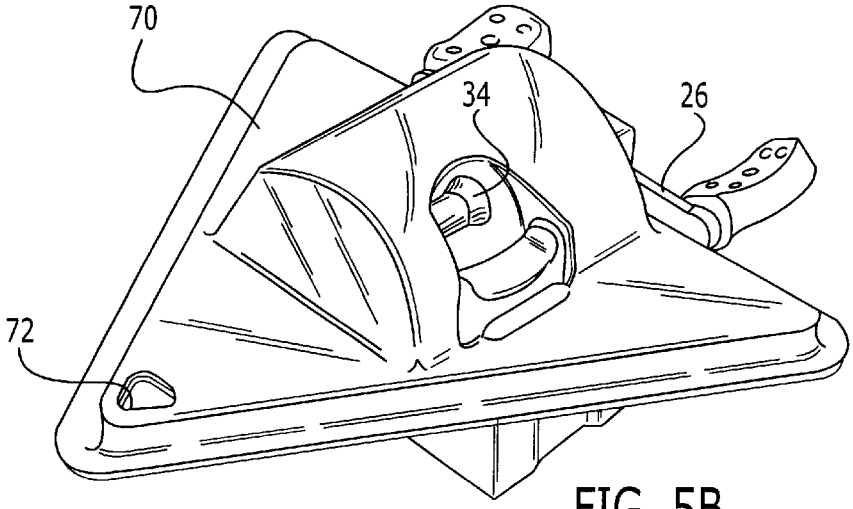
FIG. 5B is a top perspective view of a second alternative embodiment of a packaged fishing reel according to the present invention.

One skilled in the art will appreciate that various other alternatives are also contemplated within the scope of the present invention. For example, FIG. 5B illustrates a package 70 configured as an equilateral triangle. A hang aperture 72 is defined adjacent one apex of the triangular structure.

Figure 5C:
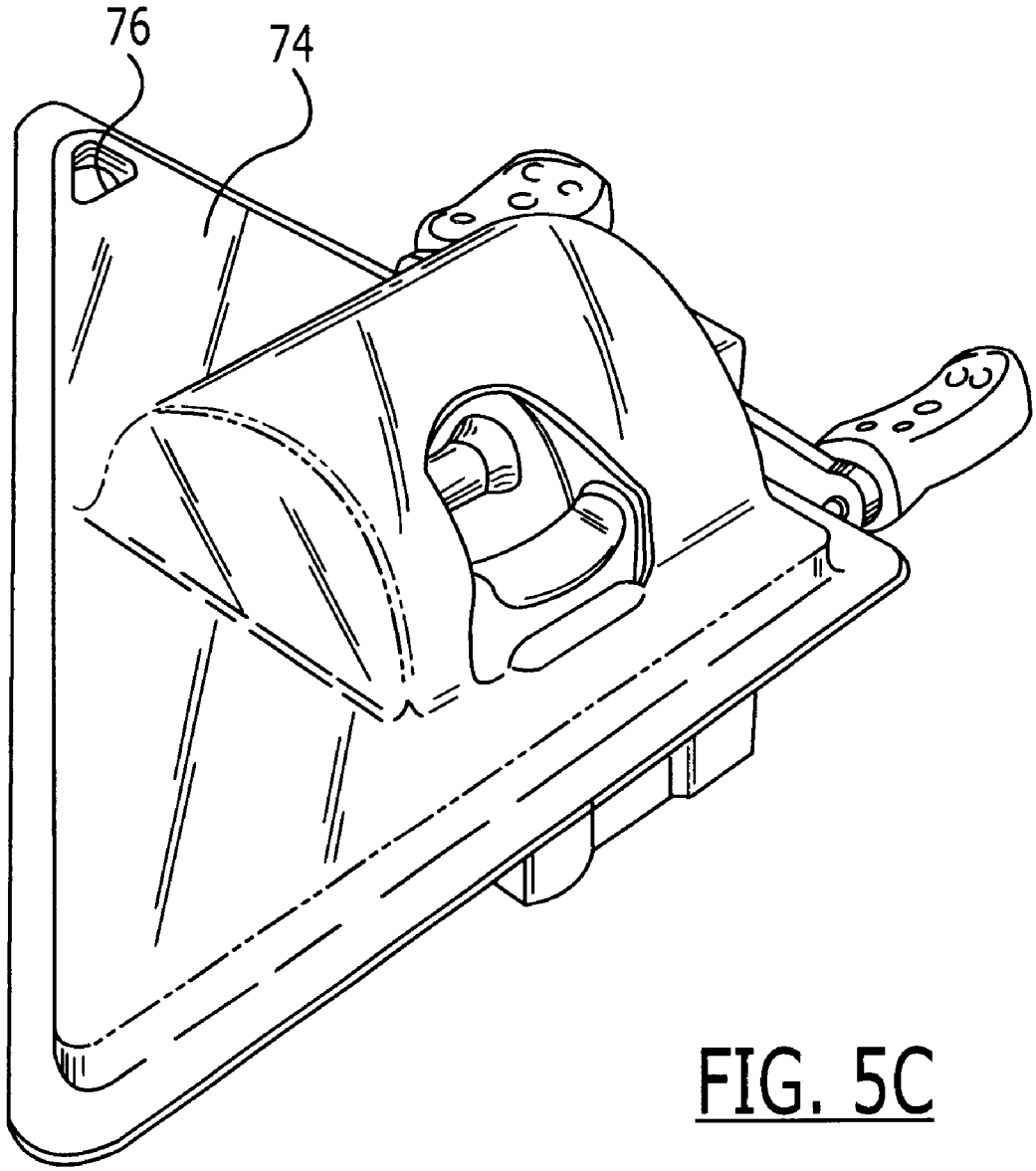
FIG. 5C is a top perspective view of a third alternative embodiment of a packaged fishing reel according to the present invention.

FIG. 5C similarly illustrates a package 74 configured as a right triangle. A hang aperture 76 is located adjacent one apex of the triangle, as shown.

Figure 6:
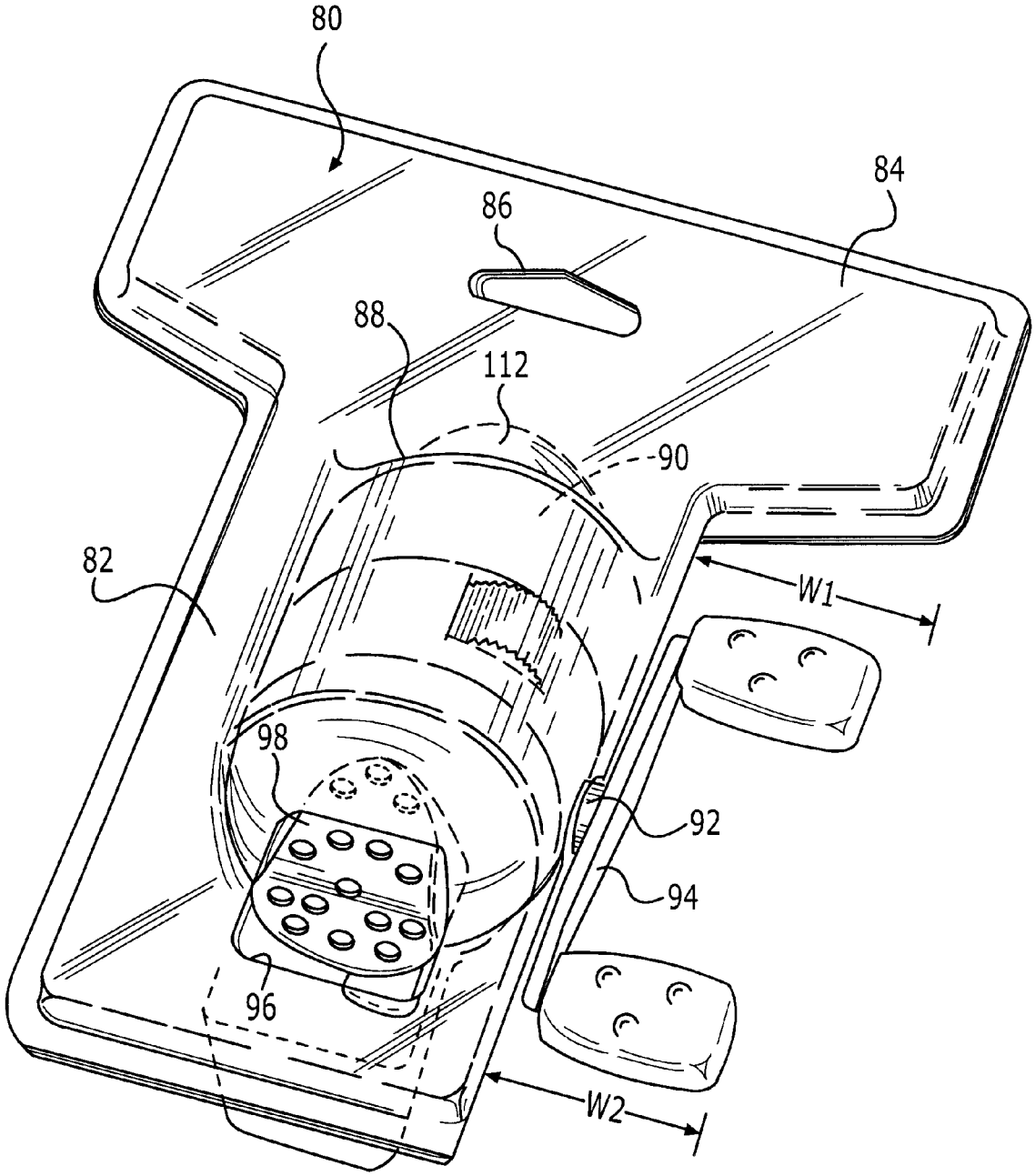
FIG. 6 is a top perspective view of a spincast reel packaged according to the present invention.
Figure 7:
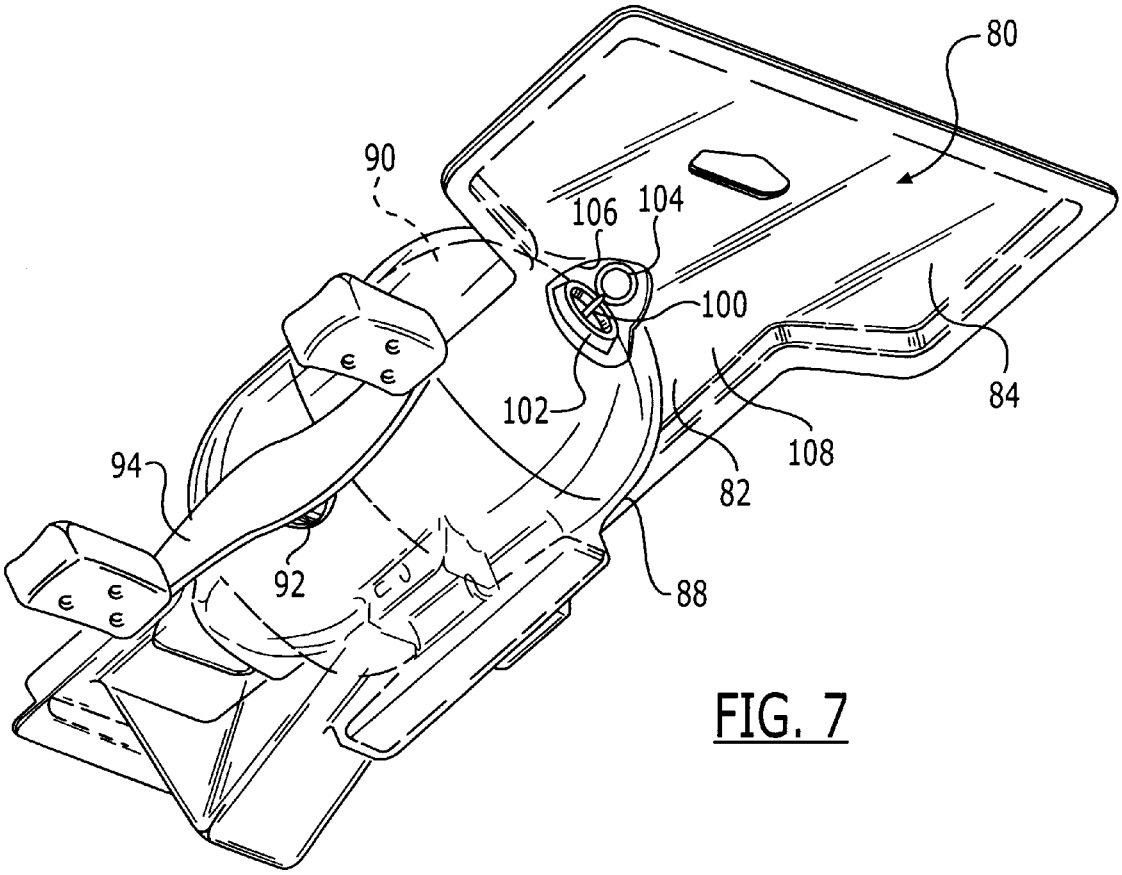
FIG. 7 is a bottom perspective view of the packaged fishing reel of FIG. 6.

While the embodiments described above have been shown in relation to a baitcast reel, it should be understood that other types of fishing reels, such as "spincast" reels, may also be packaged according to the present invention. For example, FIG. 6 illustrates a package 80 containing a typical spincast reel.

Like package 14, package 80 has a generally T-shaped configuration formed by a lower portion 82 of lesser width and an upper portion 84 of greater width. A hang aperture 86 is provided in upper portion 84, as shown. Lower portion 82 defines a configured reel enclosure 88 in which the reel's body 90 is contained.

A rotatable crank 92 extends from reel body 90 through a crank opening defined in package 80. A crank handle 94 is located at the distal end of crank 92 so as to be exterior to the package. A posterior opening 96 is defined in package 80 to provide access to the reel's thumb button 98.

It will be appreciated that package 80 permits a consumer to operate crank handle 94 and thumb button 98 while the fishing reel remains packaged. Like other embodiments having a T-shaped configuration, upper portion 84 will preferably extend laterally from lower portion 82 by a distance W1 greater than the lateral extent W2 of crank handle 94. As a result, upper portion 84 will provide a degree of protection to the exposed handle, as well as yielding an aesthetically pleasing appearance.

Unlike baitcast reels, spincast reels are typically equipped with fishing line when sold. In this case, for example, the reel includes fishing line 100 extending through the front eyelet 102 of reel body 90. A tab 104 is provided to prevent the line 100 from being pulled back into the reel body.

In order to allow the consumer to more fully test the reel prior to purchase, package 80 preferably defines a line opening 106. A consumer can pull a predetermined length of line 100 through opening 106, away from the reel body. Rotation of crank handle 94 by the consumer draws the line back into the reel body.

Figure 8:
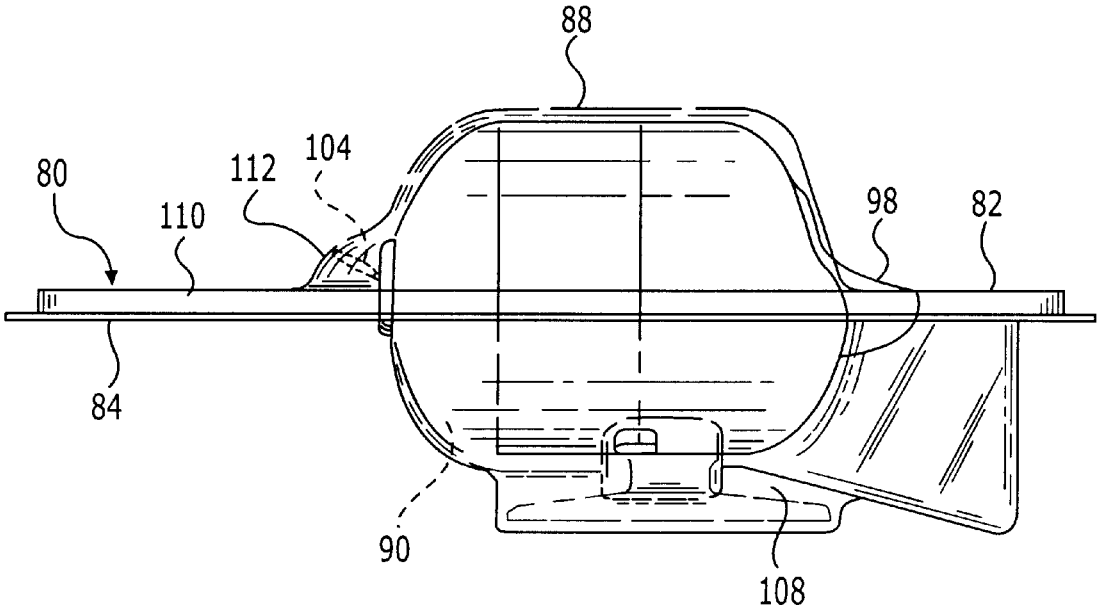
FIG. 8 is a side elevation of the packaged fishing reel of FIG. 6.

Like package 14, package 80 is preferably formed of a first shell 108 and a second shell 110 joined together about their respective peripheries. In this case, line opening 106 can be defined entirely in first shell 108. Second shell 110 can advantageously define a bubble portion 112 opposed to the line opening. Preferably, bubble portion 112 is sized so that tab 104 can be received completely therein, as shown in FIG. 8. In this manner, tab 104 will remain relatively unexposed until a consumer decides to test the reel.

It can be seen that the present invention provides improved packaging for fishing reels, in furtherance of the noted objects. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A fishing reel packaging arrangement comprising:

a fishing reel having a rotatable crank extending from a reel body, said rotatable crank having a crank handle located thereon;

a display package for display and packaging of the reel at the point of sale, said display package having a configured reel enclosure in which said reel body is located, said package further defining a crank opening through which said rotatable crank extends such that said crank handle will be located exterior to said package for rotation by a user; and said package defining a hang aperture spaced from said configured reel enclosure.

2. A fishing reel packaging arrangement as set forth in claim 1, wherein said package is formed of a semirigid plastic material.

3. A fishing reel packaging arrangement as set forth in claim 2, wherein said fishing reel includes a thumb button located on said reel body, said package further defining a posterior opening at said configured reel enclosure so that said user can operate said thumb button.

4. A fishing reel packaging arrangement as set forth in claim 3, wherein said fishing reel is a baitcast reel.

5. A fishing reel packaging arrangement as set forth in claim 3, wherein said fishing reel is a spincast reel.

6. A fishing reel packaging arrangement as set forth in claim 2, wherein said package comprises a first shell and a second shell of said plastic material, said first and second shells being joined together about respective peripheries thereof.

7. A fishing reel packaging arrangement as set forth in claim 6, wherein said package has a generally T-shaped configuration formed by a lower portion of lesser width and an upper portion of greater width.

8. A fishing reel packaging arrangement as set forth in claim 7, wherein said configured reel enclosure is located in said lower portion of lesser width and said hang aperture is located in said upper portion of greater width.

9. A fishing reel packaging arrangement as set forth in claim 8, wherein said upper portion will extend laterally from at least one side of said lower portion by a lateral distance at least equal to a lateral extent of said crank handle.

10. A fishing reel packaging arrangement as set forth in claim 6, wherein said package has a generally triangular configuration in which said hang aperture is located adjacent an apex thereof.

11. A fishing reel packaging arrangement as set forth in claim 2, wherein said package further defines a foot opening at said configured reel enclosure, said fishing reel including a mounting foot exposed through said foot opening.

12. A fishing reel packaging arrangement comprising:

a fishing reel having a reel body carrying a crank handle and a thumb button;

a display package for display and packaging of the reel at the point of sale, said display package formed of a first shell and a second shell made of a semirigid plastic material, said first shell and said second shell being joined together about respective peripheries thereof to provide a reel enclosure in which said reel body is located; and said crank handle being located exterior to said package for rotation by a user, said package further defining a posterior opening such that said user can operate said thumb button.

13. A fishing reel packaging arrangement as set forth in claim 12, wherein said package defines a hang aperture spaced from said reel enclosure.

14. A fishing reel packaging arrangement as set forth in claim 13, wherein said fishing reel is a baitcast reel.

15. A fishing reel packaging arrangement as set forth in claim 13, wherein said fishing reel is a spincast reel.

16. A fishing reel packaging arrangement as set forth in claim 15, wherein said package further defines a line opening providing access to an end portion of fishing line carried by said spincast reel.

17. A fishing reel packaging arrangement as set forth in claim 16, wherein said line opening is defined in said first shell of said package, said second shell defining a bubble portion opposed to said line opening for receipt of a line tab therein.

18. A fishing reel packaging arrangement as set forth in claim 13, therein said package further defines a foot opening at said configured reel enclosure, said fishing reel including a mounting foot exposed through said foot opening.

19. A fishing reel packaging arrangement comprising:

a fishing reel having a reel body carrying a crank handle and a thumb button;

a display package for dismay and packaging of the reel at the point sale, said display package defining a reel enclosure in which said reel body is located;

said crank handle being located exterior to said package for rotation by a user, said package defining a posterior opening at said reel enclosure such that said user can operate said thumb button; and said package further defining a hang aperture spaced from said configured reel enclosure.

20. A display package for displaying a fishing reel at the point of sale, said reel being of the type including a reel body, a rotatable crank, and a thumb button, said package comprising:

a first shell and a second shall of semirigid plastic material coined together about respective peripheries thereof, said first and second shells defining a configured reel enclosure in which said reel body is located and further defining a hang aperture spaced from said configured reel enclosure;

said package further defining a crank opening through which said rotatable crank extends such that said crank handle will be located exterior to said package for rotation by a user; and a posterior opening defined at said configured reel enclosure so that said user can operate said thumb button.

21. A package as set forth in claim 20, defining a foot opening at said configured reel enclosure through which a mounting foot of said fishing reel is exposed.

* * * * *